US011761285B2

(12) United States Patent
Baugh

(10) Patent No.: US 11,761,285 B2
(45) Date of Patent: Sep. 19, 2023

(54) METHOD FOR CONTROLLING PRESSURE IN BLOWOUT PREVENTER RAM SEALS

(71) Applicant: Benton Frederick Baugh, Houston, TX (US)

(72) Inventor: Benton Frederick Baugh, Houston, TX (US)

( * ) Notice: Subject to any disclaimer, the term of this patent is extended or adjusted under 35 U.S.C. 154(b) by 6 days.

(21) Appl. No.: 17/386,758

(22) Filed: Jul. 28, 2021

(65) Prior Publication Data

US 2023/0030422 A1 Feb. 2, 2023

(51) Int. Cl.
*E21B 33/06* (2006.01)

(52) U.S. Cl.
CPC ..... *E21B 33/062* (2013.01)

(58) Field of Classification Search
CPC ..... E21B 33/062; E21B 33/063
See application file for complete search history.

(56) References Cited

U.S. PATENT DOCUMENTS 2,146,470 A * 2/1939 Grantham ..... F16K 31/508 251/266
4,229,012 A 10/1980 Williams
4,492,359 A 1/1985 Baugh
4,508,312 A 4/1985 Williams
4,508,313 A * 4/1985 Jones ..... E21B 29/08 251/1.3
4,541,639 A 9/1985 Williams
4,579,314 A 4/1986 Williams
4,582,293 A * 4/1986 Jones ..... E21B 33/062 251/1.3
2016/0032677 A1* 2/2016 Hopson ..... E21B 33/06 166/55
2019/0100974 A1* 4/2019 Mozisek ..... E21B 34/02
2019/0203555 A1* 7/2019 Gallagher ..... E21B 33/063

* cited by examiner

*Primary Examiner* — Daphne M Barry

(57) ABSTRACT

The method of preventing pressures higher than a predetermined pressure in the front ram seals of blowout preventer rams comprising providing blowout preventer rams suitable for sealing across the bore of a blowout preventer stack, providing seals on the blowout preventer rams which sealingly isolate the bore area below or upstream of the blowout preventer rams from the area above or downstream of the blowout preventer rams, providing a passageway from the front to the rear of the blowout preventer rams to vent the upstream or higher pressures to the rear of the blowout preventer rams, and communicating the resilient seal material in the front ram seals with a pressure release piston which will relieve the pressure at the predetermined pressure.

6 Claims, 5 Drawing Sheets

METHOD FOR CONTROLLING PRESSURE IN BLOWOUT PREVENTER RAM SEALS

TECHNICAL FIELD

This invention relates to the method of controlling pressure in blowout preventer rams seals, especially as it applies to a 20,000 p.s.i. blowout preventer stack.

CROSS-REFERENCE TO RELATED APPLICATIONS

Not applicable.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

Deepwater offshore drilling requires that a vessel at the surface be connected through a drilling riser and a large blowout preventer stack to the seafloor wellhead. The seafloor wellhead is the structural anchor piece into the seabed and the basic support for the casing strings which are placed in the well bore as long tubular pressure vessels. During the process of drilling the well, the blowout preventer stack on the top of the subsea wellhead provides the second level of pressure control for the well. The first level being provided by the weighted drilling mud within the bore.

During the drilling process, weighted drilling mud circulates down a string of drill pipe to the drilling bit at the bottom of the hole and back up the annular area between the outside diameter of the drill pipe and the inside diameter of the drilled hole or the casing, depending on the depth.

Coming back up above the blowout preventer stack, the drilling mud will continue to travel back outside the drill pipe and inside the drilling riser, which is much large than the casing. The drilling riser has to be large enough to pass the casing strings run into the well, as well as the casing hangers which will suspend the casing strings. The bore in a contemporary riser will be at least twenty inches in diameter. It additionally has to be pressure competent to handle the pressure of the weighed mud, but does not have the same pressure requirement as the blowout preventer stack itself.

As wells are drilled into progressively deeper and deeper formations, the subsurface pressure and therefore the pressure which the blowout preventer stack must be able to withstand becomes greater and greater. This is the same for drilling on the surface of the land and subsea drilling on the surface of the seafloor. Early subsea blowout preventer stacks were of a 5,000 p.s.i. working pressure, and over time these evolved to 10,000 and 15,000 p.s.i. working pressure. As the working pressure of components becomes higher, the pressure holding components naturally become both heavier and taller. Additionally, in the higher pressure situations, redundant components have been added, again adding to the height. The 15,000 blowout preventer stacks have become in the range of 800,000 lbs. and 80 feet tall. This provides enormous complications on the ability to handle the equipment as well as the loadings on the seafloor wellhead. In addition to the direct weight load on the subsea wellheads, side angle loadings from the drilling riser when the surface vessel drifts off the well centerline are an enormous addition to the stresses on both the subsea wellhead and the seafloor formations.

When the blowout preventer stack working pressure is increased to 20,000 p.s.i. some estimates of the load is that it increases from 800,000 to 1,200,000 lbs. The height also increases, but how much is unclear at this time but it will likely approach 100 feet in height.

A complication is that the stresses in the seals on the face of the rams in annular blowout preventers becomes enormous. They are characteristically pressure energized by having a larger pressure area behind the rams than the area of the face seals. When the pressure behind the rams is 20,000 p.s.i., the pressure in the face seals is some high multiple of that. In the rams discussed following, the pressure in the resilient seals will exceed 68,000 p.s.i. Resilient materials at these pressures are likely to fail in various ways, including simply extruding through the smallest of available cracks.

Another complication is that the pressure energized characteristic of the blowout preventer rams is a necessary characteristic, especially at lower pressures. When sealing at lower pressures, the pressure energizing characteristic assists in the sealing and in retaining the seal integrity over a long period of time when the actuator pressure loading may be lost.

It has long been known that the pressure in the resilient seals at the front of blowout preventer rams has ben excessively high, especially as the working pressure has been increasing from 5,000 to 10,000 and then to 15,000 p.s.i., but the natural geometry of the blowout preventer rams and lack of an adequate solution has resulted in the industry simply accepting the situation as it was and accepting the risks.

BRIEF SUMMARY OF THE INVENTION

The object of this invention is to provide a way to regulate the maximum pressure seen in blowout preventer ram seals.

A second object of this invention is to not restrict the necessary pressure energizing characteristic of the blowout preventer rams at low pressures.

A third object of this invention is allow the rams to come together face to face to prevent high pressure generation within the ram seals.

Another object of this invention is to prevent ultra-high pressures in the ram to ram cavity seals.

BRIEF DESCRIPTION OF THE DRAWINGS

FIG. 3 is a perspective view of a subsea wellhead housing which the blowout preventer stack of this invention would land on.

DETAILED DESCRIPTION OF THE INVENTION

Figure 1:
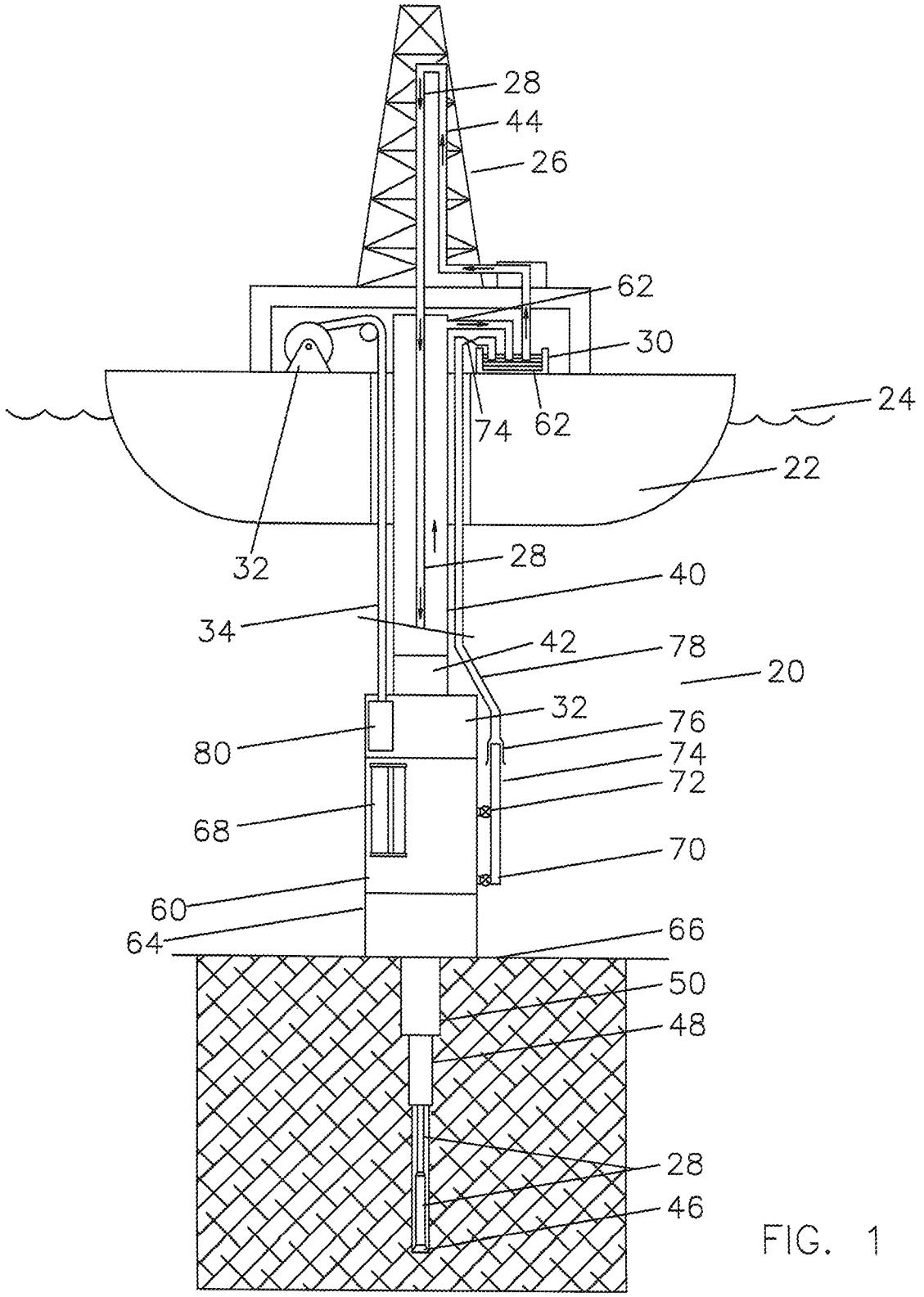
FIG. 1 is a view of a contemporary deep-water riser system.

Referring now to FIG. 1, a view of a system 20 which might use the present invention is shown. It shows a floating vessel 22 on a body of water 24 and having a derrick 26. Drill pipe 28, drilling mud system 30, control reel 32, and control cable 34 are shown. A riser system 40 including a flex joint 42 is shown. During drilling the drilling mud circulated from the drilling mud system 30, up the standpipe 44, down the drill pipe 28, through the drill bit 46, back up through the casing strings 48 and 50, through the blowout preventer stack 60, up thru the riser system 40, and out the bell nipple at 62 back into the mud system 30.

Blowout preventer stack 60 is landed on a subsea wellhead system 64 landed on the seafloor 66. The blowout preventer stack 60 includes pressurized accumulators 68, kill valves 70, choke valves 72, choke and kill lines 74, choke and kill connectors 76, choke and kill flex means 78, and control pods 80.

Figure 2:
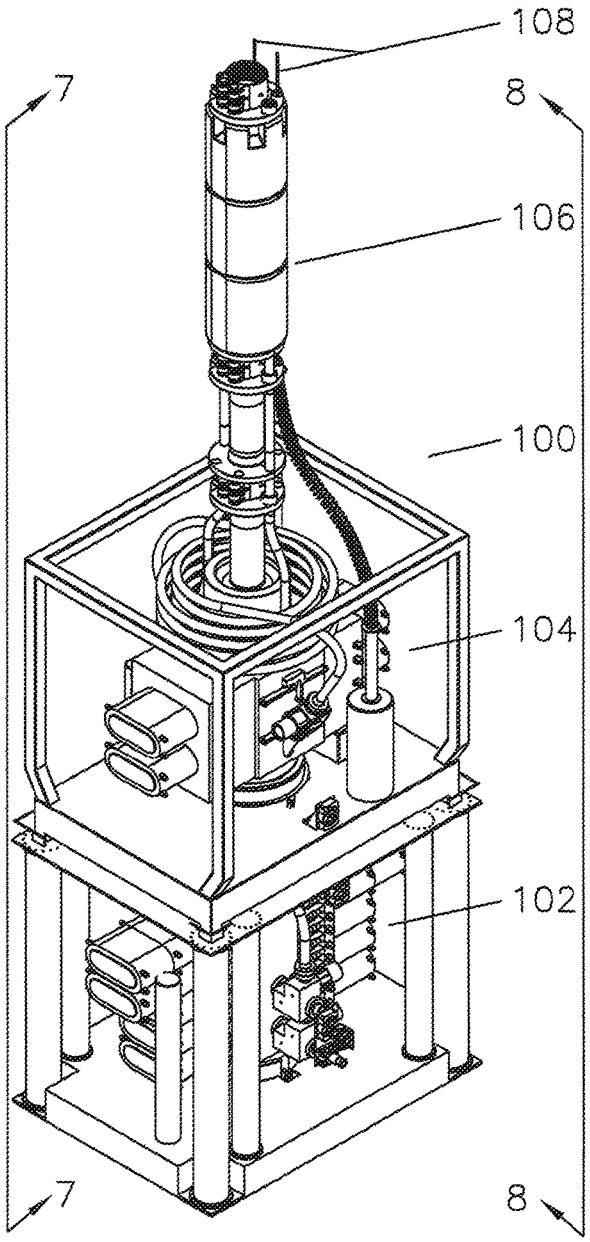
FIG. 2 is a perspective view of a blowout preventer stack utilizing the features of this invention.

Referring now to FIG. 2, the seafloor drilling system 100 comprises a lower blowout preventer stack 102, a lower marine riser package 104, a drilling riser joint 106, and control cables 108.

Figure 3:
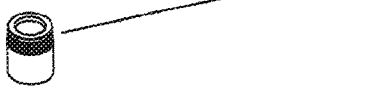

Referring now to FIG. 3, a subsea wellhead is shown which the seafloor drilling system lands on. It is the unseen upper portion of the subsea wellhead system 64 shown in FIG. 1.

Figure 4:
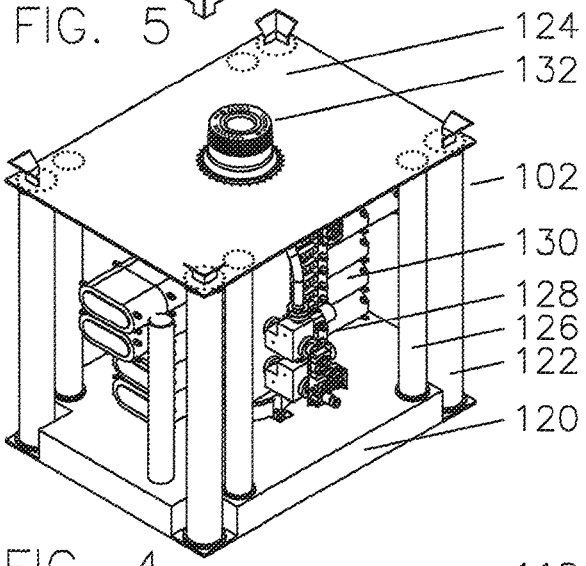
FIG. 4 is a perspective view of the lower portion of the blowout preventer stack of FIG. 2, generally called the lower BOP stack.

Referring now to FIG. 4, the lower blowout preventer stack 102 comprises a lower structural section 120, vertical support bottle 122, and upper structural section 124, accumulators 126, choke and kill valves 128, blowout preventers 130 and an upper mandrel 132 which will be the connection point for the lower marine riser package.

Figure 5:
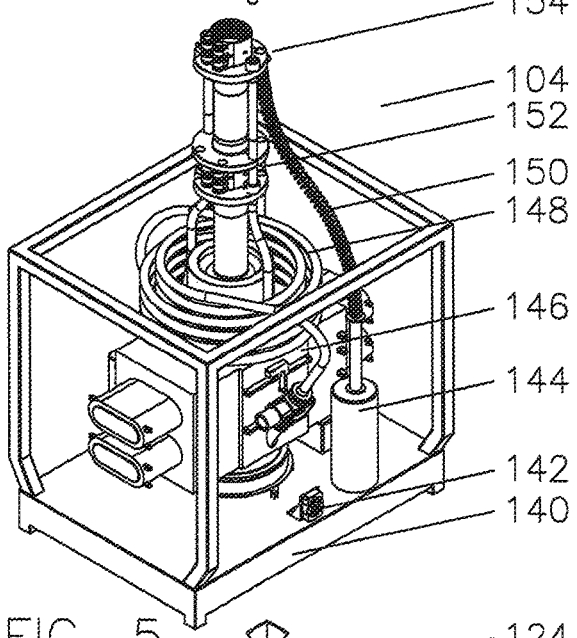
FIG. 5 is a perspective view of the upper portion of the blowout preventer stack of FIG. 2, generally called the lower marine riser package or LMRP.

Referring now to FIG. 5 the lower marine riser package 104 is shown comprising a lower marine riser package structure 140, an interface 142 for a remotely controlled vehicle (ROV), annular blowout preventers 146, choke and kill flex loops 148, a flexible passageway 150, a riser connector 152, and an upper half of a riser connector 154.

Figure 6:
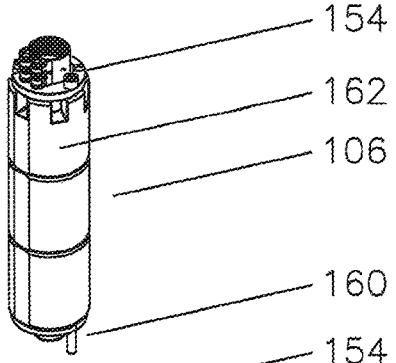
FIG. 6 is a perspective view of a section of the drilling riser which will be used to lower the blowout preventer stack.

Referring now to FIG. 6, a drilling riser joint 106 is shown having a lower half of a riser connector 160, a upper half of a riser connector 154, and buoyancy sections 162.

Figure 7:
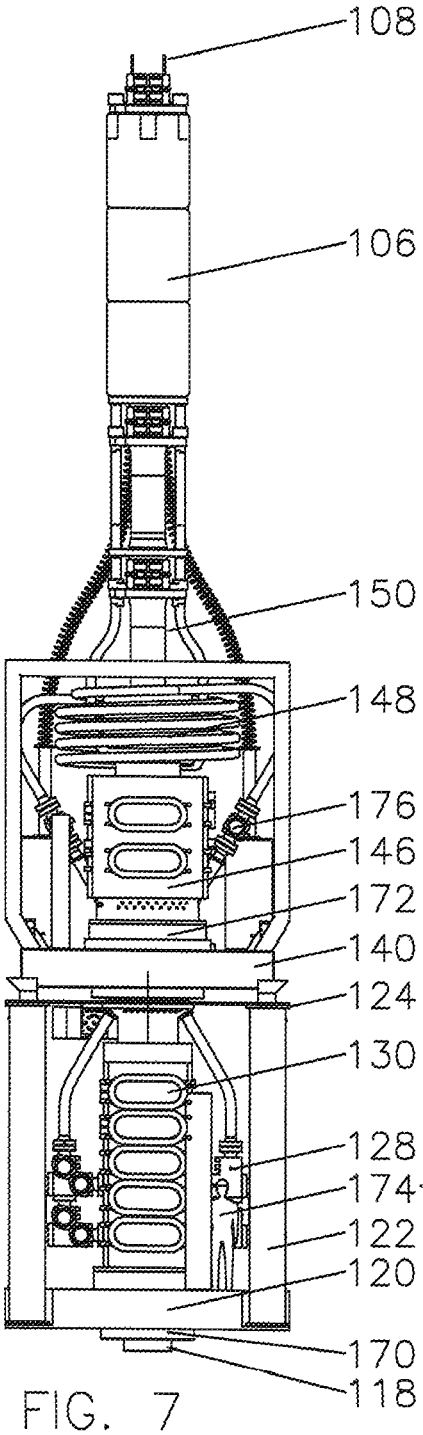
FIG. 7 is a view of the blowout preventer stack of FIG. 2, taken along lines "7-7.

Referring now to FIG. 7, is a view of seafloor drilling system 100 taken along lines "7-7" of FIG. 1 showing wellhead connector 170, lower marine riser connector 172, a man 174 for size perspective, and choke and kill valves 176.

Figure 8:
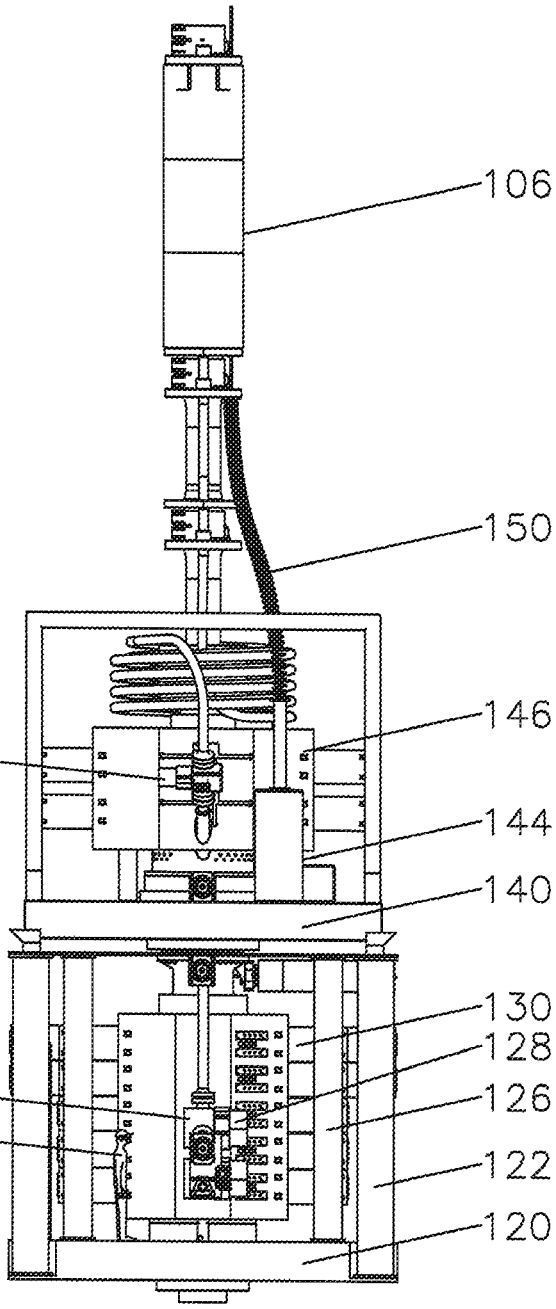
FIG. 8 is a view of the blowout preventer stack of FIG. 2, taken along lines "8-8.

Referring now to FIG. 8, is a view of seafloor drilling system 100 taken along lines "8-8" of FIG. 1.

Figure 9:
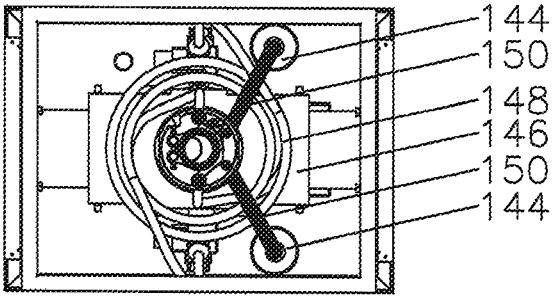
FIG. 9 is a top view of FIG. 8.

Referring now to FIG. 9, is a top view of seafloor drilling system 100.

Figure 10:
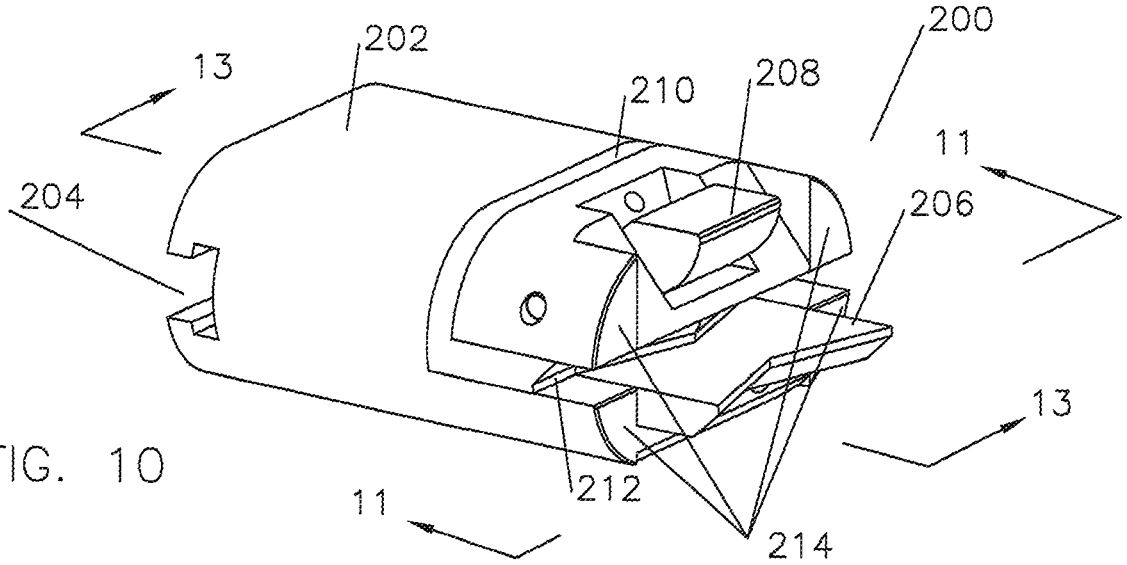
FIG. 10 is a perspective view of a blowout preventer ram.

Referring now to FIG. 10, a perspective view of a blowout preventer ram 200 is shown. In this case a shear ram is shown, but the same characteristic would apply to other rams, such as pipe rams and blind rams. Blowout preventer ram 200 has a body 202, a rear profile 204 for engagement of an actuating rod from an actuator, a shear blade 206 and a pipe lifter 208. Body seal 210 which engages the ram cavity in a blowout preventer continues around to a face seal 212. Blowout preventer ram 200 also has forwarding faces 214.

Figure 11:
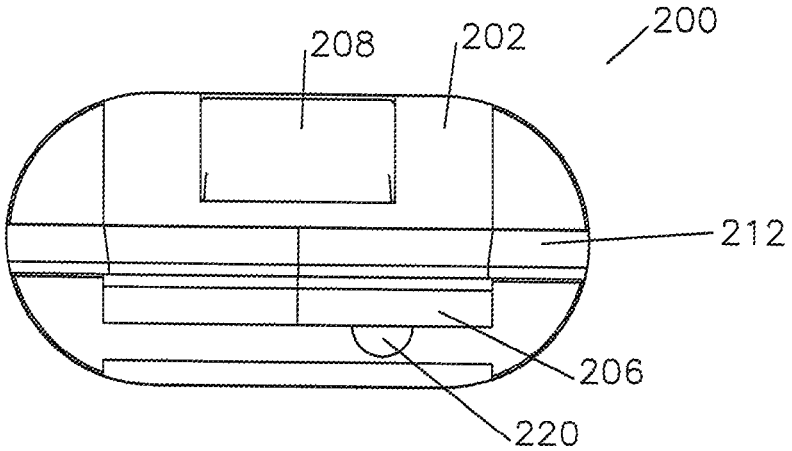
FIG. 11 is taken along lines "11-11" of FIG. 10 and is a front view of blowout preventer ram.

Referring now to FIG. 11 which is taken along lines "11-11" of FIG. 10, front view of blowout preventer ram 200 is shown with hole 220 which provides pressure and flow communication from the front to the rear of the ram 200.

Figure 12:
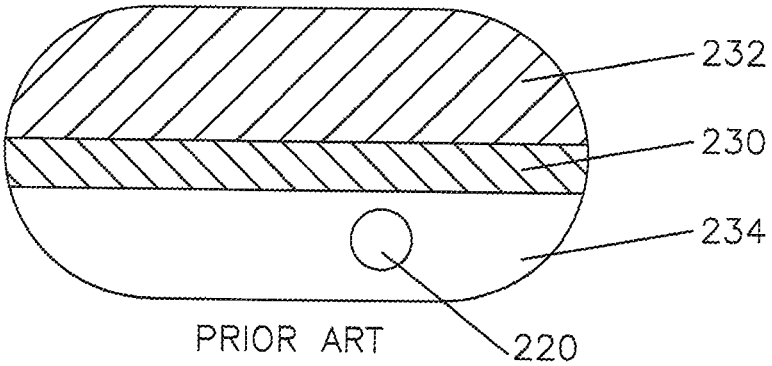
FIG. 12 PRIOR ART
FIG. 12 is a simplified schematic of FIG. 11 showing pressure areas.

Referring now to FIG. 12 which is a simplified schematic of FIG. 11 showing area 230 which is the area of face seal 212 which will contact the opposing areas on a mating ram and effectively would provide the resisting force for a conventional ram moving forward. Area 232 above area 230 will be the area which will be exposed to the lower pressure above the rams on the front. Area 234 will be exposed to the higher pressure below the rams on the front. As the high pressure below the communicated to the rear of the ram through hole 220, the entire ram will see the high pressure from below the rams on the rear. This means that the area 234 on the front and rear of the ram will see the higher pressure from below the ram and simply be cancelled out. Area 232 will see the high pressure on the rear of the ram and the low pressure on the front of the ram and will result in a force tending to move the ram forward. Area 230 will see the high pressure on the rear of the ram, and will result in a pressure on the front to resist the high pressure on the rear plus whatever pressure it takes to handle the resulting force from area 232.

In the case of the ram which is used in these figures, the area of area 230 is 429.8 sq. in. and the area of areas 230 and 232 is 1477.2 sq. in. or a ratio of 3.437/1. This means that if there is 20,000 p.s.i. on the rear of the ram (and below the rams), the pressure in the seals resisting the force will be 68,739 p.s.i., an extremely high resilient seal pressure.

Figure 13:
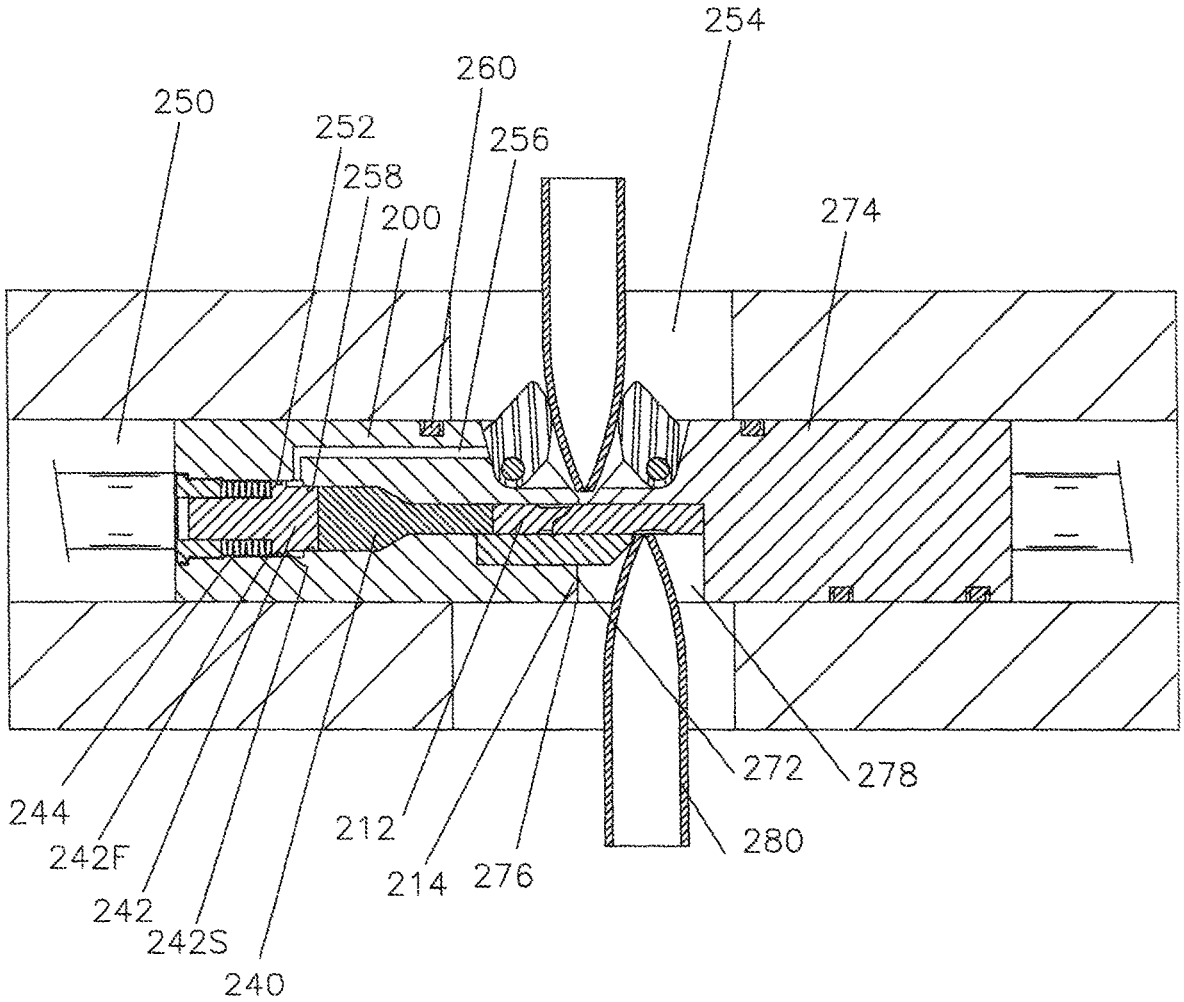
FIG. 13 is taken along lines "13-13" of FIG. 10 and shows a method of limiting ultra-high pressure in the front ram seal.

Referring now to FIG. 13 which is taken along lines "13-13" of FIG. 10, a method of limiting ultra-high pressure in the front seal 212 is shown. The object of this invention is to limit this pressure to something greater than 20,000 p.s.i. so it will actually seal, but not above a slightly higher pressure such as 25,000 p.s.i. When the pressure in front seal 212 exceeds the desired or predetermined limit such as 25,000 p.s.i., the seal element 240 is moved backwards against pressure release piston 242 which compresses springs 244. When the pressure behind the blowout preventer rams is 20,000 p.s.i. and is pressing on the area of seal 252 on the first side 242F of pressure release piston 242 and the pressure above the blowout preventer rams 254 communicated through port 256 and presses on the area between seals 252 and 258 on the second side 242S of pressure release piston 242, the combination will resist the loading of the seal element 240 to the predetermined amount, or 25,000 p.s.i. in this case. This in turn limits the pressure in the front seal 212 to 25,000 p.s.i. as they are effectively in fluid contact and in turn limits the pressure in body seal 260 as it is in functional fluid contact with front seal 212. This is termed fluid contact as resilient material such as the front seal when is a confined space transmits pressure much like a liquid This allows the lower shear ram 200 to continue to move forward slightly until the face 214 of lower shear ram 200 and the face 272 of upper shear ram 274 contact at 276.

Whereas in this view there does not appear to be a contact point due to the central clearance 278 are for the lower sheared pipe section 280, there are generous contact areas on each side of the clearance area. In this way the high energizing forces can energize the seal to a sealing pressure higher than the pressure to be sealed, but can avoid generating ultra-high pressures within the front seal as the rams 200 and 274 come face to face on metal portions.

Additionally as the body seals are connected to the face seal, this method also prevents ultra-high pressures in the seals between the blowout preventer ram and the ram body cavity.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

That which is claimed is:

1. A method of limiting pressures in front ram seals of one or more blow out preventer rams for a blowout preventer with a bore and ram cavities in which the high or upstream pressure is below the one or more said blowout preventer rams and the lower or downstream pressure is above the one or more said blowout preventer rams, comprising providing the one or more said blow out preventer rams suitable for sealing across the bore of a blowout preventer stack, contacting the metal portions of the one or more said blow out preventer rams in a sealing position, providing one or more seals on the one or more said blow out preventer rams which sealingly isolate the bore area below or upstream of the one or more said blowout preventer rams from the area above or downstream of the one or more said blowout preventer rams, providing a passageway from front to rear of the one or more said blowout preventer rams to vent the upstream or higher pressures to the rear of the one or more said blowout preventer rams, communicating a resilient seal material in the front ram seals with a pressure release piston which will relieve the pressure in the resilient material.

2. The method of claim 1, wherein the pressure release piston is loaded with springs.

3. The method of claim 1, wherein the pressure release piston loaded on a first side by the pressure which is behind the one or more said blow out preventer rams.

4. The method of claim 3, wherein the area of first side of the pressure release piston is greater than the area of the second side of the pressure release piston which engages the resilient material.

5. The method of claim 3, wherein the pressure release piston partially loaded on a second side by the pressure which is in the blowout preventer bore above the one or more said blow out preventer rams.

6. The method of claim 1, wherein the pressure in the seals between the one or more said blowout preventer rams and the ram cavity is prevented from exceeding a predetermined pressure.

* * * * *